US005874855A

United States Patent [19]

Azuma et al.

[11] Patent Number: 5,874,855

[45] Date of Patent: Feb. 23, 1999

[54] VOLTAGE TRANSFERRING DEVICE CAPABLE OF HOLDING BOOST VOLTAGE AND TRANSFERRING IN HIGH SPEED BOOST VOLTAGE

[75] Inventors: Mitsuhiro Azuma; Frank Matthews, both of Toyko, Japan

[73] Assignee: NEC Corporation, Tokyo, Japan

[21] Appl. No.: 834,941

[22] Filed: Apr. 7, 1997

[30] Foreign Application Priority Data

Apr. 5, 1996 [JP] Japan ..... 8-083425

[51] Int. Cl.[6] ..... G05F 1/10; G05F 3/02

[52] U.S. Cl. ..... 327/589; 327/537

[58] Field of Search ..... 327/390, 530, 327/534, 535, 536, 537, 538, 540, 541, 543, 589

[56] References Cited

U.S. PATENT DOCUMENTS

| | | | |
|---|---|---|---|
| 4,124,806 | 11/1978 | Rusznyak | 327/589 |
| 5,502,415 | 3/1996 | Matsui et al. | 327/536 |
| 5,521,547 | 5/1996 | Tsukada | 327/589 |

*Primary Examiner*—My-trang Nu Ton

*Attorney, Agent, or Firm*—Young & Thompson

[57] ABSTRACT

In a voltage transferring device connected between a voltage supplying section and a voltage receiving section, the voltage supplying section supplies, in a transferring period, a boost voltage having a boost level to the voltage receiving section. The voltage supplying section has, in a non-transferring period, a non-transferring voltage which has a non-transferring level smaller than the boost level. A transferring field effect transistor has a source electrode connected to the voltage supplying section and a drain electrode connected to the voltage receiving section. A controlling circuit is connected to a substrate electrode of the transferring FET. The voltage controlling circuit supplies, in the transferring period, a high voltage having the boost level to the substrate electrode of the transferring FET. The controlling circuit supplies, in the non-transferring period, a low voltage having the non-transferring level to the substrate electrode of the transferring FET. The controlling circuit comprises first and second FETs. The first FET has a drain electrode connected to the source electrode of the transferring FET and a source electrode connected to the substrate electrode of the transferring FET. The second FET has a source electrode connected to the substrate electrode of the transferring FET and a drain electrode connected to the drain electrode of the transferring FET.

15 Claims, 12 Drawing Sheets

FIG. 11

(OPERATION OF S1 SELECTED)

| | FIRST PRECHARGE PERIOD | BOOST PERIOD | SECOND PRECHARGE PERIOD |
|---|---|---|---|
| $\overline{PC}$ | L | H | L |
| $Q_{41}$ | ON | OFF | ON |
| BST | Vcc | Vcc+α | Vcc |
| BKS1 | H | H | H |
| BKS2 | L | L | L |
| $\overline{TS1}$ | H | L | H |
| $\overline{TS2}$ | H | H | H |
| QT1 | OFF | ON | OFF |
| QB1 | OFF | OFF | OFF |
| QBS1 | ON | ON | ON |
| QT2 | OFF | OFF | OFF |
| QB2 | ON | ON | ON |
| QBS2 | OFF | OFF | OFF |
| NW1 | Vcc | Vcc+α | Vcc+α (−ΔV) |
| NW2 | Vcc | Vcc+α | Vcc |
| BTL1 | Vcc | Vcc+α | Vcc+α (−ΔV) |
| BTL2 | Vcc | Vcc | Vcc |

VOLTAGE TRANSFERRING DEVICE CAPABLE OF HOLDING BOOST VOLTAGE AND TRANSFERRING IN HIGH SPEED BOOST VOLTAGE

BACKGROUND OF THE INVENTION

This invention relates to a voltage transferring device, and more particularly, to a voltage transferring device which is applied to an output section of a boost voltage generating circuit and which comprises a suitable field effect transistor (FET) of an insulating gate type.

Description of the Related Art

A semiconductor integrated circuit sometimes needs a high voltage which is greater than a power supply voltage which is supplied to the semiconductor integrated circuit. In is event, the semiconductor integrated circuit internally generates the high voltage by boosting the power supply voltage and supplies the high voltage to lines and circuit blocks which need the high voltage.

For example, in a semiconductor integrated circuit such as a semiconductor memory device which is operated in a low voltage, it is assumed that such as a word line is operated in the high voltage greater than the power supply voltage, a capacity of a voltage transferring line of a FET of a memory cell is increased. As a result, since a high level of writing datum in the memory cell is increased, stability of the memory cell is increased. Therefore, the semiconductor integrated circuit uses a voltage boosting circuit which operates the word line in the high voltage greater than the power supply voltage. In the voltage boosting circuit which supplies the high voltage greater than power supply voltage to the circuit block, the voltage boosting circuit, in an only necessary period, supplies the high voltage to the circuit block. The voltage boosting circuit uses a voltage transferring device which, in one way, transfers the high voltage to the circuit block.

In the manner which will be described more in detail, a first conventional voltage transferring device is connected between a voltage boosting circuit, as a voltage supplying section, and voltage receiving sections. The first conventional voltage transferring device selectively transfers a boost voltage having a boost level from the voltage boosting circuit to the voltage receiving sections. The boost voltage is greater than the power supply voltage.

The first conventional voltage transferring device comprises two FETs. A source electrodes of the FETs are connected to a precharge node through a connection line L. Drain electrodes of the FETs are connected to the voltage receiving sections, respectively.

However, since the first conventional voltage transferring device prevents decrease of the boost level on the side of the voltage receiving sections by repeating the boost operation, the voltage of the precharge node is once decreased at the power supply every precharges. Therefore, since a voltage of the connection line connected directly to the precharge node is periodically decreased, the voltage of the connection line is periodically lower than that of the voltage receiving sections. As a result, since electric charges flow from the voltage receiving sections to the connection line, the voltages of the voltage receiving sections are decreased. Therefore, the first conventional voltage transferring device has a wrong characteristic of transferring and holding the boost voltage. Thus, the first conventional voltage transferring device has a disadvantage that it is impossible to repeat the boost operation in a state of holding a boost level because the electric charges flow from the voltage receiving sections to the connection line.

In the manner which will be described in detail, a second conventional voltage transferring device further comprises a transferring FET in the first conventional voltage transferring device. The transferring FET is connected between the voltage boosting circuit and the first conventional voltage transferring device. The transferring FET prevents electric charge flow from the connection line to the voltage boosting circuit. Therefore, it is possible to hold the voltage of the connection line in the second conventional voltage transferring device.

However, since the second conventional voltage transferring device comprises the transferring FET, two FETs are serially connected between the voltage boosting circuit and each of the voltage receiving sections. Therefore, since the voltage boosting circuit has a great parastic resistance, it is hardly possible for the second conventional voltage transferring device to transfer, in a high speed, the boost voltage to the voltage receiving sections. Also, the second conventional voltage transferring device has a disadvantage that the two FETs has great areas for accelerating.

SUMMARY OF THE INVENTION

It is therefore an object of this invention to provide a voltage transferring device which is capable of holding a boost voltage of a connection line.

It is another object of this invention to provide a voltage transferring device which is capable of transferring, in a high speed, a boost voltage to a voltage receiving section.

It is a further object of this invention to provide a voltage transferring device which has a small area.

Other objects of this invention will become clear as the description proceeds.

According to an aspect of this invention, there is provided a voltage transferring field effect transistor connected between a voltage supplying circuit at a first node and a voltage receiving circuit at a second node, the voltage supplying circuit supplying a first voltage level to the first node during a first period and supplying a second voltage level which is smaller than the first voltage level to the first node during a second period, wherein during the first period the voltage transferring field effect transistor becomes conductive and a back bias voltage of the voltage transferring field effect transistor is set to a voltage of the first node and during the second period, the voltage transferring field effect transistor becomes non-conductive and the back bias voltage of the voltage transferring field effect transistor is set to the voltage of second node.

According to another aspect of this invention, there is provided a voltage transferring device connected between a voltage supplying section and a voltage receiving section, the voltage supplying section supplying, in a transferring period, a boost voltage having a boost level to the voltage receiving section, the voltage supplying section having, in a non-transferring period, a non-transferring voltage which has a non-transferring level smaller than the boost level, the voltage transferring device comprising:

a transferring field effect transistor having a source electrode connected to the voltage supplying section and a drain electrode connected to the voltage receiving section; and a controlling circuit connected to a substrate electrode of the transferring field effect transistor, the voltage controlling circuit supplying, in the transferring period, a high voltage having the boost level to the substrate electrode of the transferring field effect transistor, and the controlling circuit supplying, in the non-transferring period, a low voltage having the non-transferring level to the substrate electrode of the transferring field effect transistor.

According to another aspect of this invention, there is provided a voltage transferring device connected between a voltage supplying section and first through n-th voltage receiving sections, where n represents an integer greater than two, the voltage supplying section supplying, in a transferring period, a boost voltage having a boost level to one of the first through n-th voltage receiving sections, the voltage supplying section having, in a non-transferring period, a non-transferring voltage which has a non-transferring level smaller than the boost level, the voltage transferring device comprising first through n-th voltage transferring circuits which are connected between the voltage supplying section and the first through n-th voltage receiving sections, respectively, one of the first through n-th voltage transferring circuits selectively transferring the boost voltage from the voltage supplying section to one of the first through n-th voltage receiving sections, each of the first through n-th voltage transferring circuits comprising:

a transferring field effect transistor having a source electrode connected to the voltage supplying section and a drain electrode connected to one of the first through n-th voltage receiving sections; and a controlling circuit connected to a substrate electrode of the transferring field effect transistor, the voltage controlling circuit supplying, in the transferring period, a high voltage having the boost level to the substrate electrode of the transferring field effect transistor, and the controlling circuit supplying, in the non-transferring period, a low voltage having the non-transferring level to the substrate electrode of the transferring field effect transistor.

BRIEF DESCRIPTION OF THE DRAWINGS

FIG. 11 is a view for use in describing operation of the voltage transferring device illustrated in FIG. 9;

DESCRIPTION OF THE PREFERRED EMBODIMENTS

Referring to FIGS. 1, 2, 3, and 4, first and second conventional voltage transferring devices will first be described for a better understanding of this invention.

Figure 1:
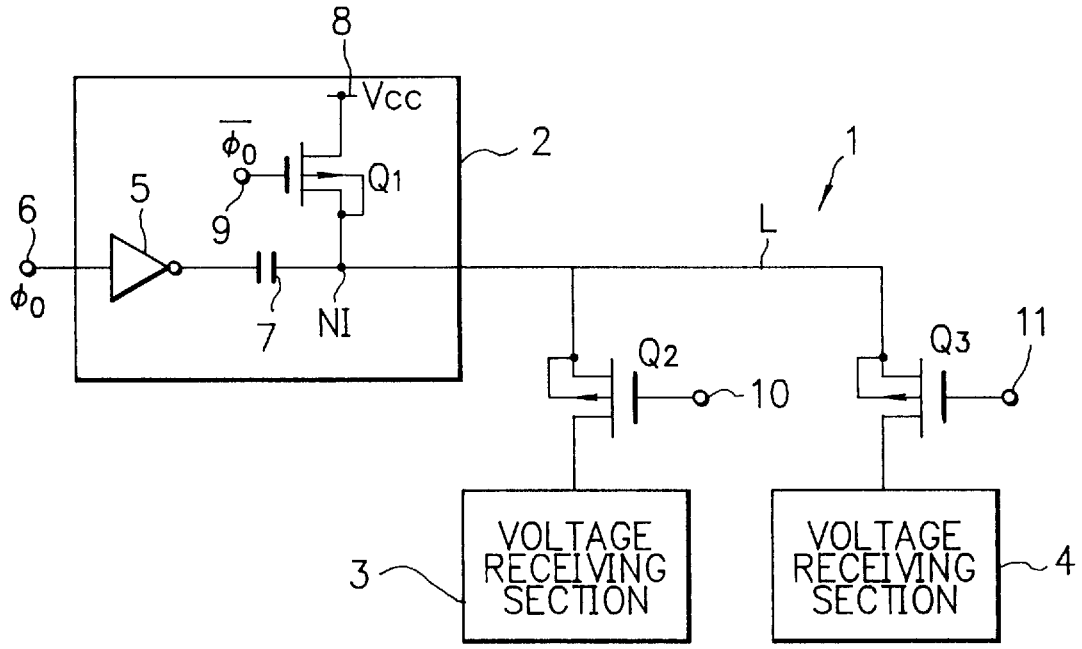
FIG. 1 PRIOR ART
FIG. 1 is a circuit diagram of a first conventional voltage transferring device.

In FIG. 1, the first conventional voltage transferring device 1 is connected between a voltage boosting circuit 2, as a voltage supplying section, and voltage receiving sections 3 and 4. The first conventional voltage transferring device 1 selectively transfers a boost voltage having a boost level from the voltage boosting circuit 2 to the voltage receiving sections 3 and 4.

The voltage boosting circuit 2 comprises an inverter 5 connected to an input terminal 6, a capacitor 7 connected to the inverter 5. and a field effect transistor (FET) Q1 of p-channel connected between the capacitor 7 and a power supply terminal 8. The input terminal 6 is supplied with a driving signal $\phi_0$. The capacitor 7 has a boost capacitance. A drain electrode of the FET Q1 is connected to the power supply terminal 8 which is supplied with a power supply voltage Vcc.

A gate electrode of the FET Q1 is supplied with an inverted driving signal $\overline{\phi}_0$ through a gate terminal 9, where "—" represents a inversion mark. The inverted driving signal $\overline{\phi}_0$ is a signal which is made by inverting the driving signal $\phi_0$.

The FET Q1 is for precharging. The capacitor 7 is, at a precharge node N1, connected to a source electrode of the FET Q1.

The first conventional voltage transferring device 1 comprises FETs Q2 and Q3. A source electrodes of the FETs Q2 and Q3 are connected to the precharge node N1 through a connection line L. A drain electrode of the FET Q2 is connected to the voltage receiving section 3. A drain electrode of the FET Q3 is connected to the voltage receiving section 4.

The capacitor 7 is charged and discharged when the input terminal 6 is supplied with the driving signal $\phi_0$ and when the gate electrode of the FET Q1 is supplied with the inverted driving signal $\overline{\phi}_0$.

The inverter 5 and the FET Q1 are controlled by the driving signal $\phi_0$ and the inverted driving signal $\overline{\phi}_0$ so that an output of the inverter 5 becomes a low level when FET Q1 is on, and so that the output of the inverter 5 becomes a high level when FET Q1 is off. Therefore, since a current flows from the power supply terminal 8 to the inverter 5 through the FET Q1, the precharge node N1, and the capacitor 7 when the FET Q1 is on, the precharge node N1 is charged at Vcc, namely, the precharge node N1 is precharged. Next, since the output of the inverter 5 becomes a high level, namely, Vcc when the FET Q1 is off, a voltage of the precharge node N1 is boosted at a voltage which is made by adding a charge voltage a of the capacitor 7 to Vcc. The charge voltage $\alpha$ ($\alpha$<Vcc) is determined by allocating an electric charge of the capacitor 7 to the connection line L and FETs Q2 and Q3. By repeating this operation, the voltage of the precharge node N1, in a precharge period, becomes Vcc, and the voltage of the precharge node N1, in a boost period, becomes Vcc+$\alpha$. The first conventional voltage transferring device 1 transfers Vcc+$\alpha$, as the boost voltage, to one of the voltage receiving sections 3 and 4. In this event, waveforms of $\overline{\phi}_0$ and $\phi_0$ and the voltage of the precharge node N1 are represented in FIG. 2.

Transfer of the boost voltage to a necessary section is carried out by the FET Q2 or Q3 of the first conventional voltage transferring device 1. A voltage of one of gate terminals 10 and 11 of the FETs Q2 and Q3 is set at a low level and a voltage of another of gate terminals 10 and 11 of the FETs Q2 and Q3 is set at a high level. When the voltage of one of gate terminals 10 and 11 of the FETs Q2 and Q3 is set at the low level, one of the FETs Q2 and Q3 that is supplied with the voltage having the low level transfers the boost voltage to one of the voltage receiving sections 3 and 4. When the voltage of the other of gate terminals 10 and 11 of the FETs Q2 and Q3 is set at the high level, other of the FETs Q2 and Q3 that is supplied with the voltage having the high level does not transfer the boost voltage to other of the voltage receiving sections 3 and 4. In this event, well voltages, or back bias voltages of the FETs Q2 and Q3 are set at the highest voltage by supplying a high voltage to substrate electrodes of the FETs Q2 and Q3. Thereby, since p-n junctions of electrodes in a side of the voltage receiving sections 3 and 4 are supplied with inverse biases, discharge of electric charge is prevented.

Figure 2:
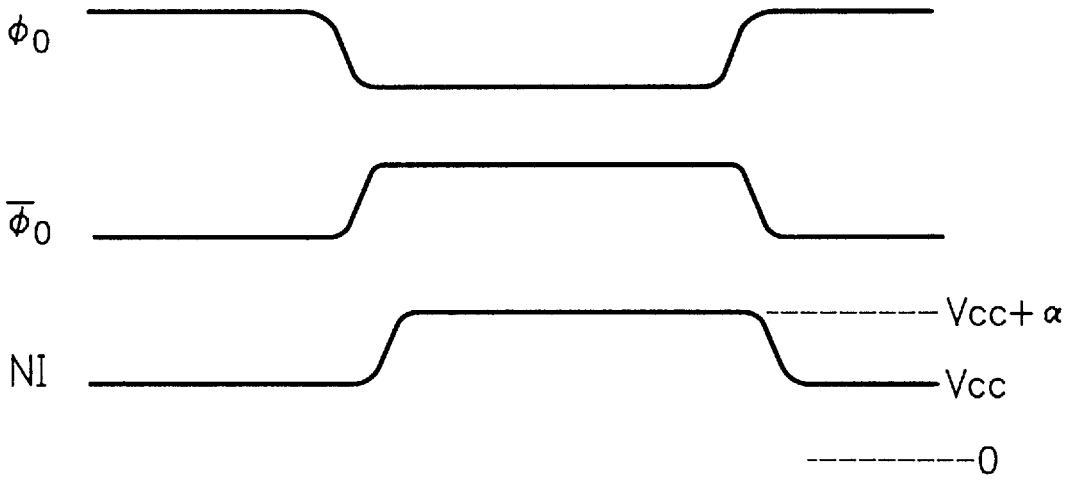
FIG. 2 PRIOR ART
FIG. 2 is a view for use in describing operation of the first conventional voltage transferring device illustrated in FIG. 1.

However, since the first conventional voltage transferring device 1 prevents decrease of the boost level on the side of the voltage receiving sections 3 and 4 by repeating the boost operation, the voltage of the precharge node N1 is decreased to Vcc every precharge as shown in FIG. 2, Therefore, since a voltage of the connection line L connected directly to the precharge node N1 is periodically decreased, the voltage of the connection line L is periodically lower than that of the voltage receiving sections 3 and 4. As a result, since electric charges flow from the voltage receiving sections 3 and 4 to the connection line L, the voltages of the voltage receiving sections 3 and 4 are decreased. Therefore, the first conventional voltage transferring device 1 has a wrong charactristic of transferring and holding the boost voltage. Thus, the first conventional voltage transferring device 1 has a disadvantage that it is impossible to repeat the boost operation in a state of holding a boost level because the electric charges flow from the voltage receiving sections 3 and 4 to the connection line L.

Figure 3:
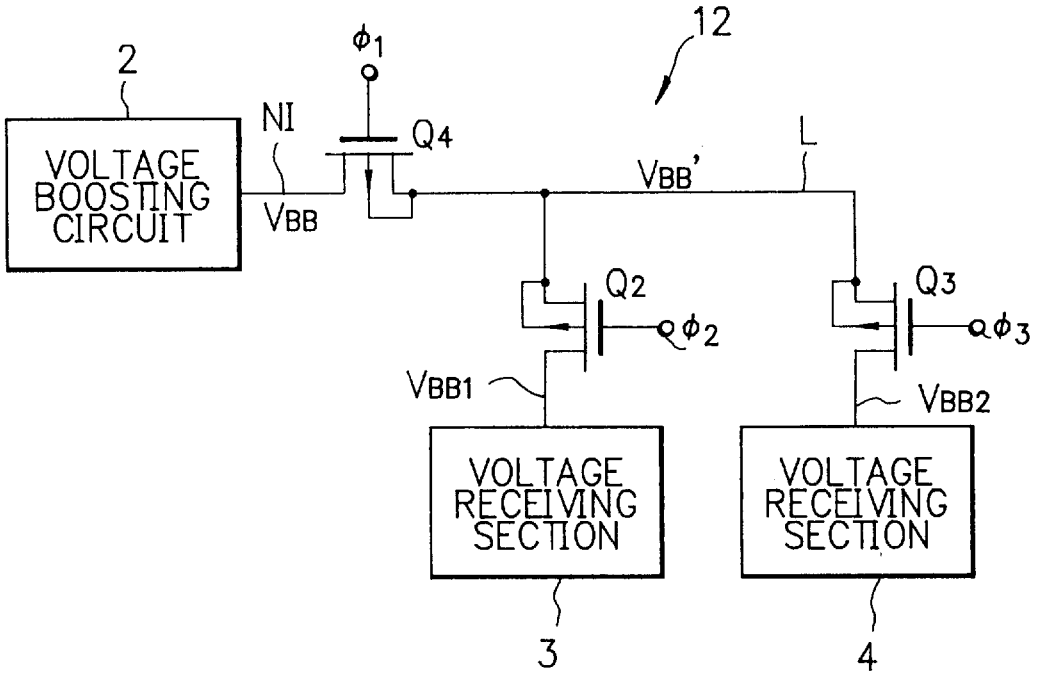
FIG. 3 PRIOR ART
FIG. 3 is a circuit diagram of a second conventional voltage transferring device.
Figure 4:
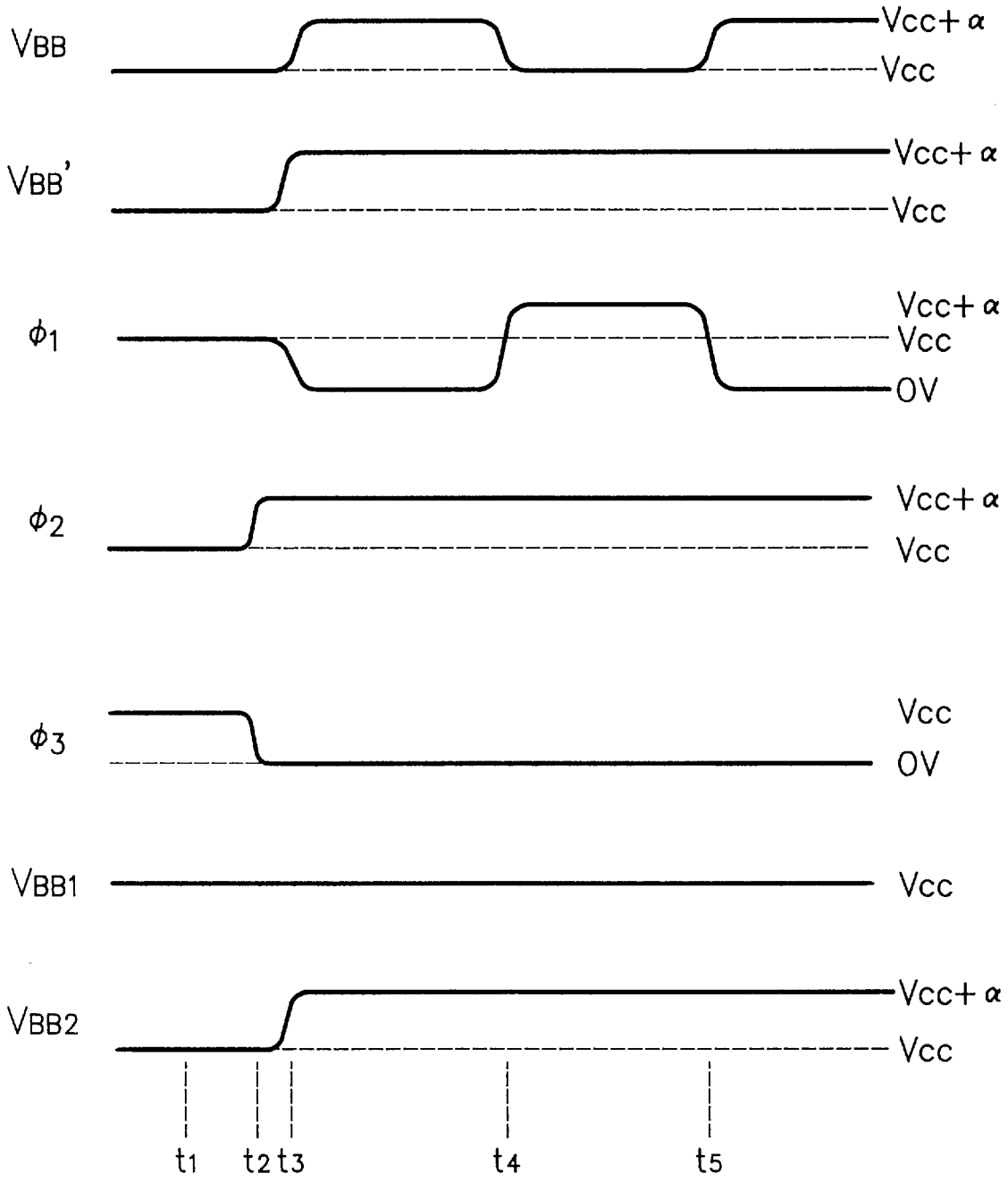
FIG. 4 PRIOR ART
FIG. 4 is a view for use in describing operation of the second conventional voltage transferring device illustrated in FIG. 3.

Referring to FIGS. 3 and 4, the description will proceed to the second conventional voltage transferring device 12. Similar parts are designated by like reference numerals.

In FIG. 3, the second conventional voltage transferring device 12 further comprises a transferring FET Q4 having a p-channel. A drain electrode of the transferring FET Q4 is connected to the precharge node N1. A source electrode of the transferring FET Q4 is connected to the source electrodes of the FET Q2 and Q3 through the connection line L. A gate electrode of the transferring FET Q4 is supplied with a gate signal $\phi$1 which is synchronized with a boost output (or a control signal of the boost circuit).

As shown in FIG. 4, it is assumed that the gate electrodes of the FETs Q2 and Q3 are supplied with gate signals $\phi$2 and $\phi$3 so that the FET Q2 becomes off and the FET Q3 becomes on after a time instant t2. Under the circumstance; the FET Q4 becomes off at a time instant t1. It is assumed that a voltage VBB' of the connection line L is Vcc. Since a first boost voltage VBB rises and the FET Q4 is synchronized with the first boost voltage VBB to become on, the first boost voltage VBB passes through the transferring FET Q4 to boost the voltage VBB' of the connection line L to Vcc+$\alpha$. At the same time, since the FET Q3 is on, a voltage VBB2 of the voltage receiving section 4 is boosted to the boost voltage Vcc+$\alpha$. Thereafter, the voltage boosting circuit 2, at a time instant t4, enters in the precharge period and the output of the voltage boosting circuit 2 is decreased. Also, since the gate signal $\phi$1 becomes a high level, the transferring FET Q4 becomes off. As a result, the voltage VBB' of the connection line L is not decreased at Vcc and is held at Vcc+$\alpha$. In addition, since the transferring FET Q4 becomes on by the above mentioned operation in the boost period of the voltage boosting circuit 2 after a time instant t5, the voltage VBB' of the connection line L is boosted.

A substrate electrode of the transferring FET Q4 is connected to the connection line L. Also, the voltage Vcc+$\alpha$ of the connection line L is supplied to a well of the transferring FET Q4. As a result, a p-n junction of a side of the voltage boosting circuit 2 in the transferring FET Q4 is supplied with an inverse bias. Thereby, it is prevented that electric charges flow from the connection line L to the voltage boosting circuit 2. Thus, it is possible to hold the voltage of the connection line L because the second conventional voltage transferring device 12 further comprises the FET Q4.

However, since the second conventional voltage transferring device 12 comprises the transferring FET Q4, two FETs are serially connected between the voltage boosting circuit 2 and the voltage receiving sections 3 and 4 such as memory arrays. Therefore, since the voltage boosting circuit 2 has a great parasitic resistance, it is hardly possible for the second conventional voltage transferring device 12 to transfer, in a high speed, the voltage to the voltage receiving sections 3 and 4. Also, the second conventional voltage transferring device 12 has a disadvantage that the two FETs has great areas for accelerating.

Referring to FIGS. 5, 6, 7, and 8, the description will proceed to a voltage transferring device according to a first embodiment of this invention. Similar parts are signated by like reference numerals.

Figure 5:
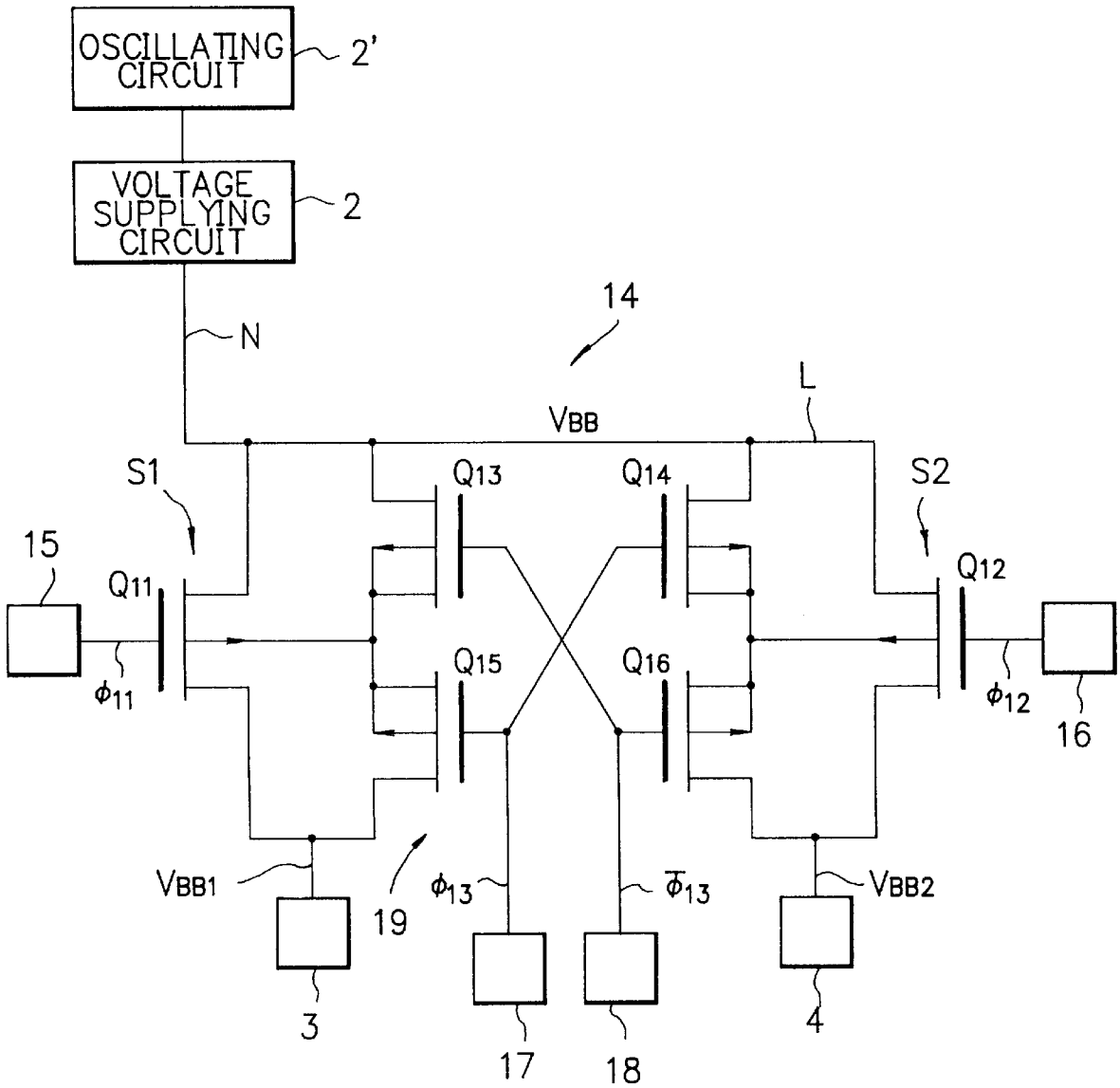
FIG. 5 is a circuit diagram of a voltage transferring device according to a first embodiment of this invention.

In FIG. 5, the voltage transferring device 14 is connected between the voltage boosting circuit 2 and the voltage receiving sections 3 and 4. The voltage transferring device 14 selectively transfers the boost voltage having the boost level from the voltage boosting circuit 2 to the voltage receiving sections 3 and 4. An oscillating circuit 2' is connected to the voltage boosting circuit 2. The oscillating circuit 2' generates an driving signal to supply the driving signal to the voltage boosting circuit 2. The voltage boosting circuit 2 is driven by the driving signal from the oscillating circuit 2'. The voltage boosting circuit 2 supplies, in a transferring period, the boost voltage Vcc+$\alpha$ having the boost level to one of the voltage receiving sections 3 and 4. Also, the voltage boosting circuit 2 has, in a non-transferring period, a non-transferring voltage Vcc having a non-transferring level smaller than the boost level.

The voltage transferring device 14 comprises transferring FETs Q11 and Q12 and FETs Q13, Q14, Q15, and Q16. Source electrodes of the transferring FETs Q11 and Q12 are connected to the precharged node N1 of the voltage boosting circuit 2 through the connection line L. Drain electrodes of the FETs Q11 and Q12 are connected to the voltage receiving sections 3 and 4, respectively. A drain electrode of the FET Q13 is connected to the source electrode of the FET Q11. A source electrode of the FET Q13 is connected to a substrate of the FET Q11. A source electrode of the FET Q15 is connected to the substrate of the FET Q11. A drain electrode of the FET Q15 is connected to the drain electrode of the FET Q11. A drain electrode of the FET Q14 is connected to the source electrode of the FET Q12. A source electrode of the FET Q14 is connected to a substrate of the FET Q12. A source electrode of the FET Q16 is connected to the substrate of the FET Q12. A drain electrode of the FET Q16 is connected to the drain electrode of the FET Q12. A first voltage transferring circuit S1 comprises the FETs Q11, Q13, and Q15. A second voltage transferring circuit S2 comprises the FETs Q12, Q14, and Q16.

A first gate voltage controlling circuit 15 is connected to a gate electrode of the FET Q11. The first gate voltage controlling circuit 15 supplies a first gate selection signal $\phi$11 to the gate electrode of the FET Q11. A second gate voltage controlling circuit 16 is connected to a gate electrodes of the FET Q12. The second gate voltage controlling circuit 16 supplies a second gate selection signal $\phi$12 to the gate electrode of the FET Q12. A third gate voltage controlling circuit 17 is connected to gate electrodes of the FETs Q14 and Q15. The third gate voltage controlling circuit 17 supplies a third gate selection signal $\phi$13 to the gate electrodes of the FET Q14 and Q15. A fourth gate voltage controlling circuit 18 is connected to gate electrodes of the FETs Q13 and Q16. The fourth gate voltage controlling circuit 18 supplies a fourth gate selection signal $\overline{\phi}_{13}$ to the gate electrodes of the FET Q13 and Q16. One of the FETs Q11 and Q12, in a boost period or in a transferring period, becomes on to supply the boost voltage to one of the voltage receiving sections 3 and 4. The FETs Q13 to Q16 and the first through fourth gate voltage controlling circuits 15 to 18 serve as a controlling circuit 19 for controlling voltages of the gate electrodes of the FETs Q13 to Q16.

Figure 6:
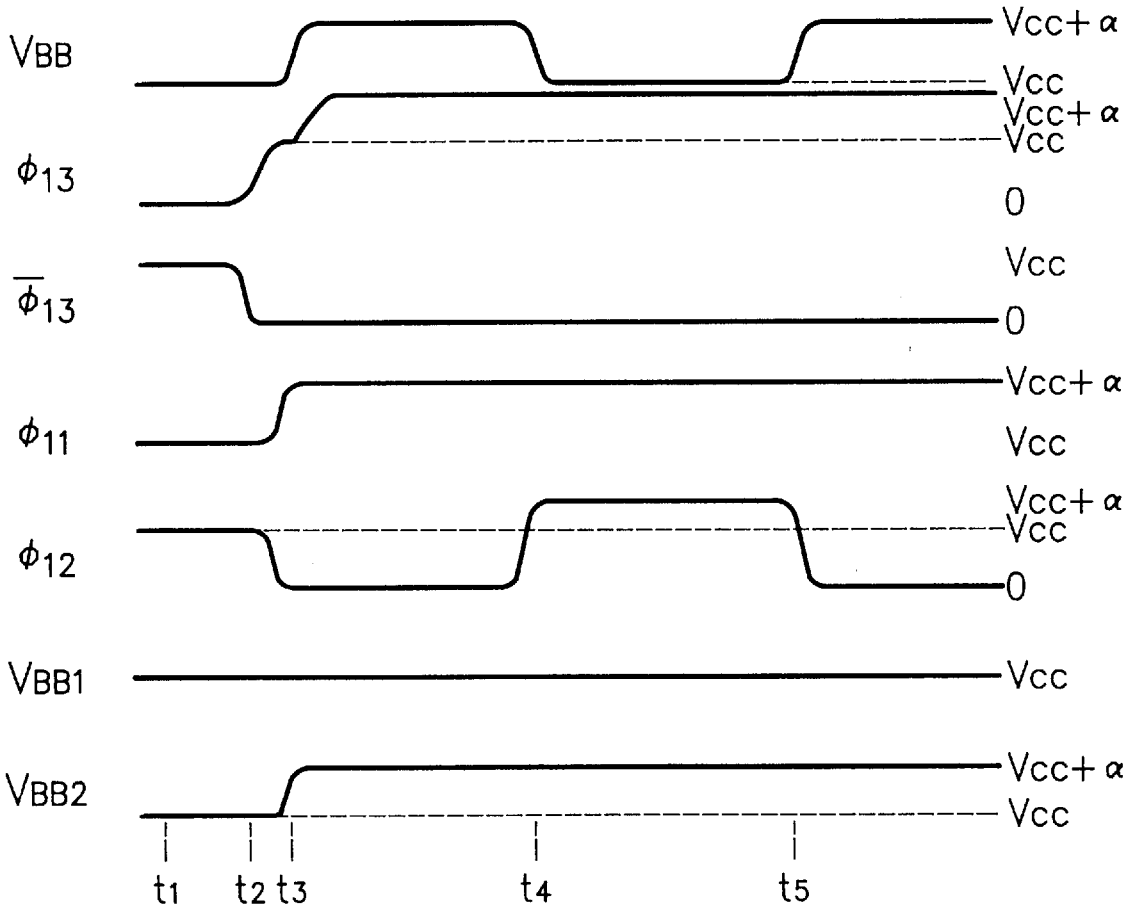
FIG. 6 is a view for use in describing operation of the voltage transferring device illustrated in FIG. 5.

Referring to FIG. 6 together with FIG. 5. the description will proceed to operation of the voltage transferring device 14. At a time instant t2, the first gate voltage controlling circuits 15 makes the FET Q11 become off (a state of a non-transferring period) and the second gate voltage controlling circuits 16 makes the FET Q12 become on (a state of a transferring period). Here, the transferring period includes a high level (Vcc+$\alpha$) supplying period and a high level keeping period. In the high level supplying period, the voltage boosting circuit 2 outputs the high level, and the selected FET is becomes on (or becomes conductive). While in the high level keeping period, the selected FET is becomes off (or becomes non-conductive), so that the receiving sections 3 and 4 keep the high level. Also, at the time instant t2, third gate selection signal $\phi$13 is set at a high level and the fourth gate selection signal $\overline{\phi}_{13}$ is set at a low level. In addition, the third gate selection signal $\phi$13 is preferably changed in response to the boost voltage so that operation of the FETs Q14 and Q15 is surely carried. Therefore, the third gate selection signal $\phi$13 is set at Vcc+$\alpha$ after a time instant t3. In the manner which will later be described, third gate selection signal $\phi$13 is supplied from a circuit which uses, as a power supply, the voltage in sides of the voltage receiving sections 3 and 4.

The voltage boosting circuit 2 outputs, as the boost voltage, the voltage Vcc+$\alpha$ at the precharge node N1. The voltage Vcc+$\alpha$ is made by adding the charge voltage $\alpha$ of the capacitor 7 to Vcc. Also, since the third gate selection signal $\phi$13 is set at Vcc+$\alpha$ (the high level) af ter the time instant t3, the FET Q11 holds off. In addition, the FET Q1 is supplied with the second gate selection signal $\phi$12 which periodically makes the FET Q12 on and off. At a time instant t3, since the second gate selection signal $\phi$12 is previously set at the low level, the boost voltage VBB (Vcc+$\alpha$) is supplied to the voltage receiving section 4 through the FET Q12.

At a time instant t4, the voltage boosting circuit 2 enters in the precharge period and the second gate selection signal $\phi$12 is switched to the high level. In this event, since the voltage receiving section 4 becomes the boost level, the high level of the second gate selection signal $\phi$12 becomes Vcc+$\alpha$ because the second gate selection signal $\phi$12 is made by using the boost level of the voltage receiving section 4. In order to normally turn off of the FET Q12, the level of the second gate selection signal $\phi$12 is similar to the level of the voltage receiving section 4 which becomes the boost level. At a time instant t5, the voltage boosting circuit 2 enters in the boost period. Thereby, the second gate selection signal $\phi$12 is switched to the low level. Thus, the output VBB1 in the voltage receiving section 3 which is not selected is held at Vcc and the output VBB2 in the voltage receiving section 4 which is selected becomes Vcc+$\alpha$ after the time instant t3.

It is to be noted that even when the voltage of the connection line L is decreased to Vcc, the output VBB2 in the voltage receiving section 4 is held at Vcc+$\alpha$. This is because back bias voltages of the FETs Q11 and Q12 is switched in response to the transferring period (selection) and the non-transferring period (non-selection).

Referring to FIGS. 7A, 7B, 8A and 8B together with FIGS. 5 and 6, the description will proceed to a operation principle of the voltage transferring device, 14. The operation principle is that the voltages of the voltage receiving sections 3 and 4 are not affected by a voltage in the precharge period of the voltage boosting circuit 2.

Figure 7A:
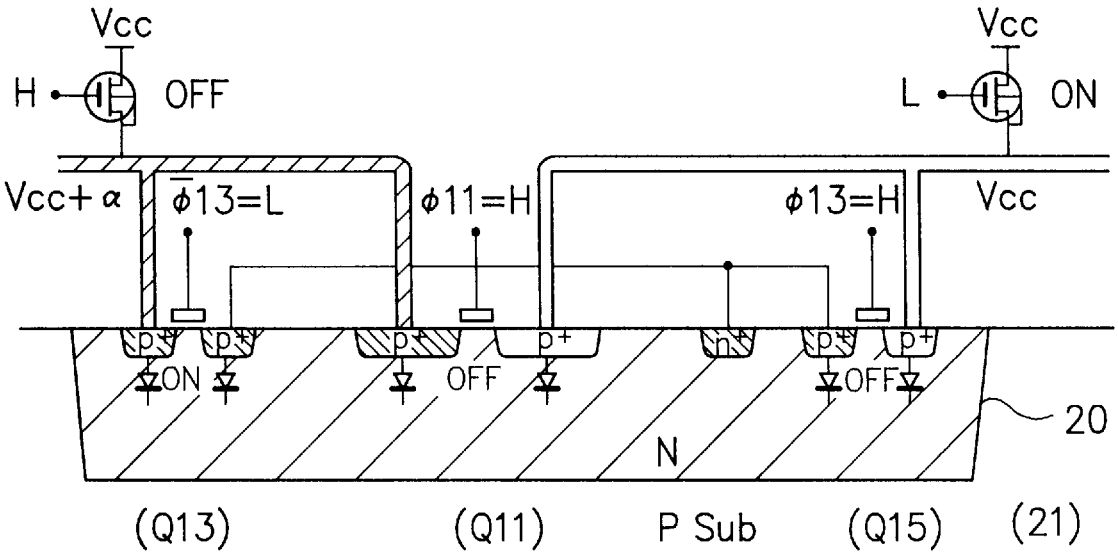
FIG. 7A is a view for use in describing a first operation state of FETs Q11, Q13, and Q15 of the voltage transferring device illustrated in FIG. 5.
Figure 7B:
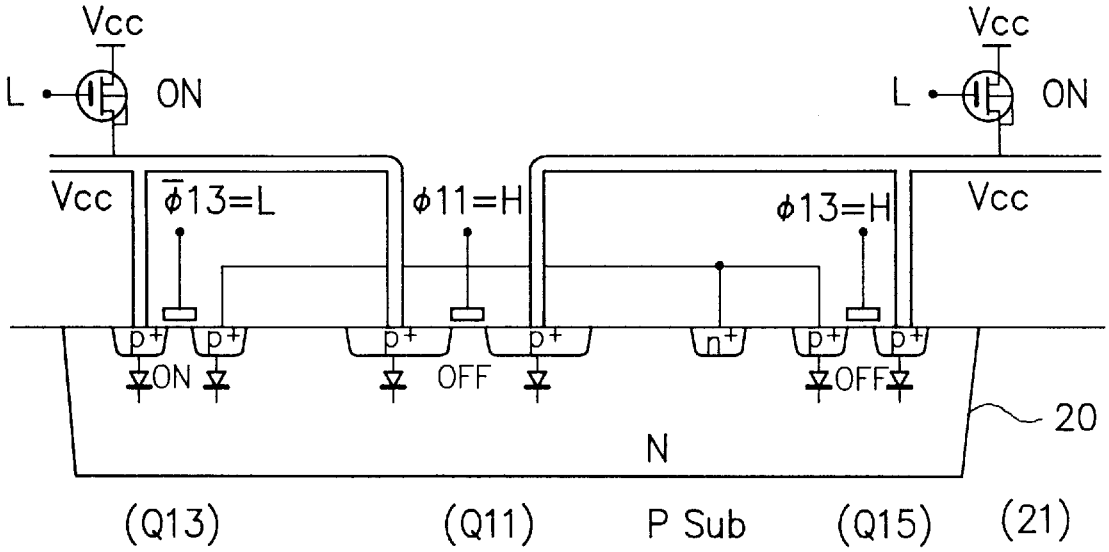
FIG. 7B is a view for use in describing a second operation state of FETs Q11, Q13, and Q15 of the voltage transferring device illustrated in FIG. 5.
Figure 8A:
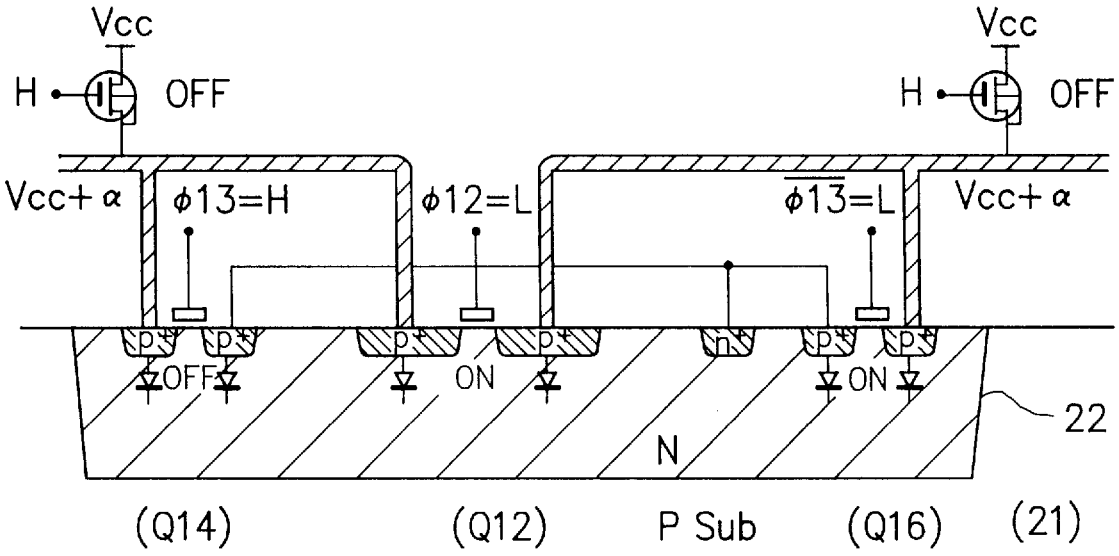
FIG. 8A is a view for use in describing a first operation state of FETs Q12, Q14, and Q16 of the voltage tansferring device illustrated in FIG. 5.
Figure 8B:
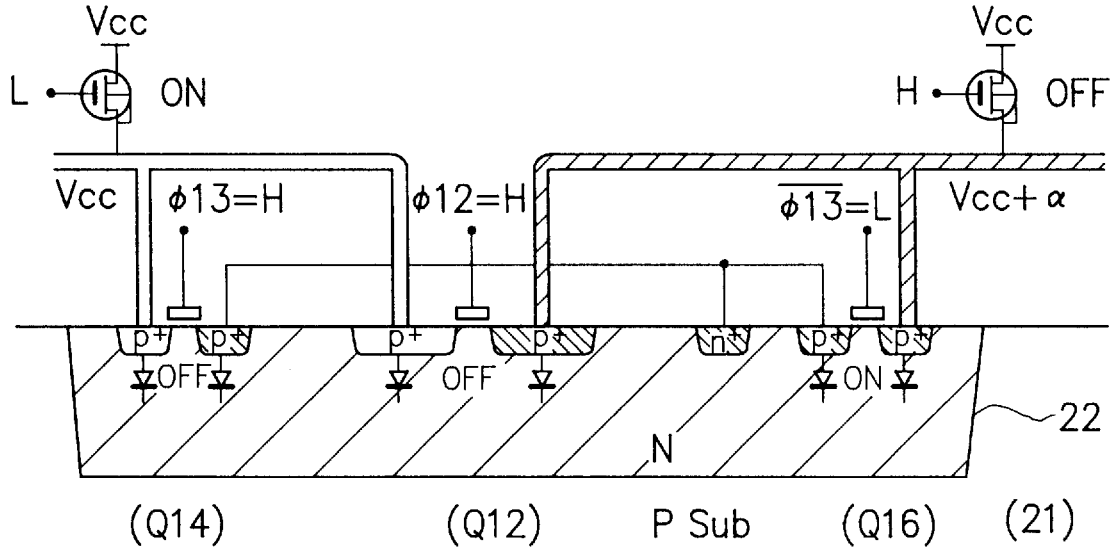
FIG. 8B is a view for use in describing a second operation state of FETs Q12, Q14, and Q16 of the voltage transferring device illustrated in FIG. 5.

In FIGS. 7A and 7B, the FETs Q11, Q13, and Q15 is formed on a n-semiconductor well 20 of a p-semiconductor substrate 21. In FIGS. 8A and 8B, the FETs Q12, Q14, and Q16 is formed on a n-semiconductor well 22 of a p-semiconductor substrate 21. In FIGS. 7A, 7B, 8A and 8B, representation of oblique lines represents the boost level and representation of no oblique lines represents the non-boost level. Each of p-n junctions between source electrodes, drain electrodes, and the wells is represented by a diode mark.

FIG. 7A represents an operation state of the boost period in which the voltage receiving section 3 is not selected. The level of the voltage of the connection line L is the boost level Vcc+$\alpha$. Since the first gate selection signal $\phi$11 is set at the high level, the FET Q11 is off. Since the fourth gate selection signal $\overline{\phi}_{13}$ is set at the low level, the FET Q13 is on. In addition, since the third gate selection signal $\phi$ . is set at the high level, the FET Q13 is off. Therefore, a voltage of the well 20 is set at the boost level through a channel and the substrate electrode (N+) of the FET Q13.

On the other hand, a voltage of the voltage receiving section 3 which is not selected is set at Vcc. Thereby, p-n junctions of the drain electrodes of the FETs Q11 and Q15 are supplied with the inverse bias. Therefore, the precharge node N1 of the voltage boosting circuit 2 is isolated from the voltage receiving section 3 which is not selected.

FIG. 7B represents a operation state of the precharge period in which the voltage receiving section 3 is not selected. In this event, the voltages of the precharge node N1 and the voltage receiving section 3 are Vcc. Therefore, electric charges of the voltage receiving section 3 do not flow to the precharge node N1.

FIG. 8A represents a operation state of the boost period in which the voltage receiving section 4 is selected. The level of the voltage of the connection line L is the boost level Vcc+α. Since the second gate selection signal ϕ12 is set at the low level, the FET Q12 is on. Since the third gate selection signal ϕ13 is set at the high level, the FET Q14 is off. Since the fourth gate selection signal $\overline{\phi}_{13}$ is set at the low level, the BET Q16 is on. Therefore, the boost voltage of the connection line L is supplied to the voltage receiving section 4 through a channel of the FET Q12. Also, a voltage of the well 22 is set at the boost level through a channel and the substrate electrode (N+) of the FET Q16.

FIG. 8B represents a operation state of the precharge period in which the voltage receiving section 4 is selected. The level of the voltage of the connection line L is the precharge level Vcc. Since the second gate selection signal ϕ12 is set at the high level, the FET Q12 is off. Since the third gate selection signal ϕ13 is set at the high level, the FET Q14 is off. Since the fourth gate selection signal $\overline{\phi}_{13}$ is set at the low level, the FET Q16 is on. Therefore, the voltage of the well 21 is set at the boost level through a channel and the substrate electrode (N+) of the FET Q16.

On the other hand, since the voltage of the connection line L is the precharge level Vcc, p-n junctions of the FETs Q12 and Q14 in the connection line L are supplied with the inverse bias. Therefore, the precharge node N1 of the voltage boosting circuit 2 is isolated from the voltage receiving section 4 which is selected.

Thus, when the voltage supplying section supplies the high voltage having a high level to the voltage receiving sections 3 and 4 which are operated in the low voltage having a low level smaller than the high level. the voltage transferring device 14, in one way, transfers the high voltage in the only transferring period. Even when the voltage of the voltage supplying section is decreased, electric charges do not flow from the voltage receiving sections 3 and 4 to the voltage supplying section. In addition, electric charges, in the non-transferring period, do not flow from the voltage supplying section to the voltage receiving sections 3 and 4.

Also, since the voltage transferring device 14 comprises the only FET Q11 or Q12 which is serially connected between the voltage supplying section and the voltage receiving sections 3 and 4, a serial resistance is not increased and it is possible to decrease mask areas of the FETs. On the other hand, the voltage transferring device 14 further needs the FETs Q13, Q15, Q14, and Q16 which controls the voltages of the substrate electrodes of the FETs Q11 and Q12. Each of the FETs Q13, Q15, Q14, and Q16 has a mask area which is equal to about one-tenth of a mask area of one of the FETs Q11 and Q12. Therefore, the FETs Q13, Q15, Q14, and Q16 have not great areas.

In addition, in FIG. 8A, the FET Q14 may be on. In this event, a new current passage comprising the FETs Q14 and Q16 is, in parallel, connected to a current passage comprising the FET Q12. Therefore, since a current capacitance is increased, it is possible to effectively use the FETs Q14 and Q16.

Referring to FIGS. 9, 10, 11, and 12, the description will proceed to a voltage transferring device according to a second embodiment of this invention. Similar parts are designated by like reference numerals.

Figure 9:
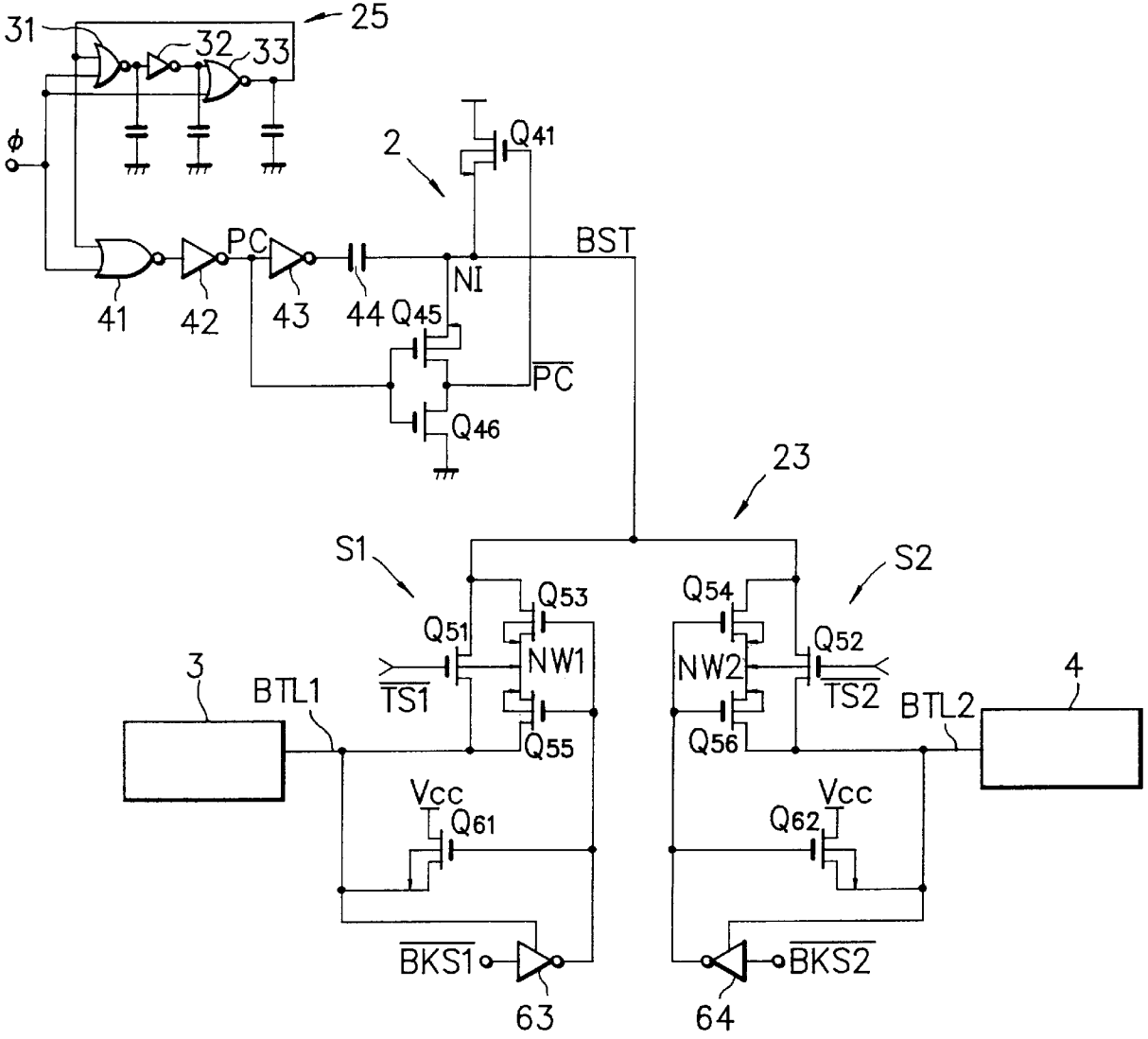
FIG. 9 is a circuit diagram of a voltage transferring device according to a second embodiment of this invention.

In FIG. 9, the voltage transferring device 23 between the voltage boosting circuit 2 and the voltage receiving sections 3 and 4. A ring oscillating circuit 25 is connected to the voltage boosting circuit 2. The ring oscillating circuit 25 comprises gate circuits 31, 32, and 33. The ring oscillating circuit 25 oscillates a pulse signal by using delays of signal in the gate circuits 31. 32, and 33. Namely, the ring oscillating circuit 25 has a feedback constrution. The ring oscillating circuit 25 is operated in response to a control signal ϕ which controls operation of the voltage boosting circuit 2 and which is synchronized with an address signal. The ring oscillating circuit 25 supplies a driving signal PC to the voltage boosting circuit 2 through gate circuits 41 and 42. The voltage boosting circuit 2 comprises an inverter 43, a capacitor 44, FETs Q41, Q45, and Q46. The FETs Q45 and Q46 supply a signal PC to the FET Q41. The ring oscillating circuit 25 supplies an output voltage BST to the voltage transferring device 23.

The voltage transferring device 23 comprises FETs Q51, Q52, Q53, Q54, Q55, and Q56 which are similar to the FETs Q11, Q12, Q13, Q14, Q15, and Q16, respectively. The voltage transferring device 23 is connected to the voltage receiving sections 3 and 4 through voltage transferring lines BTL1 and BTL2. The first voltage transferring circuit S1 comprises Q51, Q53, and Q55. The second voltage transferring circuit S2 comprises Q52, Q54, and Q56. Gate electrodes of the FETs Q51 and Q52 are supplied with signals TS1 and TS2 so that the gate electrodes of the FETs Q51 and Q52 are supplied with signals BKS1 and BKS2 in synchronizing with the precharge operation. The signals TS1 and TS2 are substantial nand logic outputs of the signal PC. The nand logic outputs of the signal PC are produced by a nand logic circuit 26 in FIG. 10.

The voltage transferring device 23 further comprises FETs Q61 and Q62 and inverters 63 and 64. The inverters 63 and 64 are supplied with signals $\overline{\text{BKS1}}$ and $\overline{\text{BKS2}}$, respectively. The inverters 63 supplies the signals BKS1 to gate electrodes of the FETs Q53 and Q56. The inverters 64 supplies the signal BKS2 to gate electrodes of the FETs Q54 and Q55. Thereby, voltages of substrate electrodes of the FETs Q51 and Q52 are controlled. In this event, power supplies of the inverters 63 and 64 supply voltages BTL1 and BTL2 so that the voltage receiving sections 3 and 4 corresponding the power supplies, in the boost period, are set at the boost level. Outputs of the inverters 63 and 64 become Vcc or signals BKS1 and BKS2. Also, it is assumed that voltages of the voltage transferring lines BTL1 and BTL2 are decreased at 0, an operation speed becomes remarkably lower because a time period of boosting the voltage becomes longer. Therefore, the voltage transferring device 23 comprises the FETs Q61 and Q62 which are connected between Power supplies Vcc and the voltage transferring lines BTL1 and BTL2. Gate electrodes of the FETs Q61 and Q62 is supplied with the signals BKS1 and BKS2 so that one of the FETs Q61 and Q62 that is not selected becomes on. Thereby, the voltages of the voltage transferring lines BTL1 and BTL2 are held at the power supply voltage Vcc. In addition, the voltages of the voltage transferring lines BTL1 and BTL2 are supplied to power supplies of the nand logic circuit 26 in FIG. 10 so that the signals TS1 and TS2 of the gate electrodes of the FETs Q51 and Q52 are set at the boost level which corresponds the boost state.

Referring to FIGS. 11. and 12 together with FIGS. 9 the FETs Q51 and Q52 are set at the boost level which corresponds the boost state.

Figure 10:
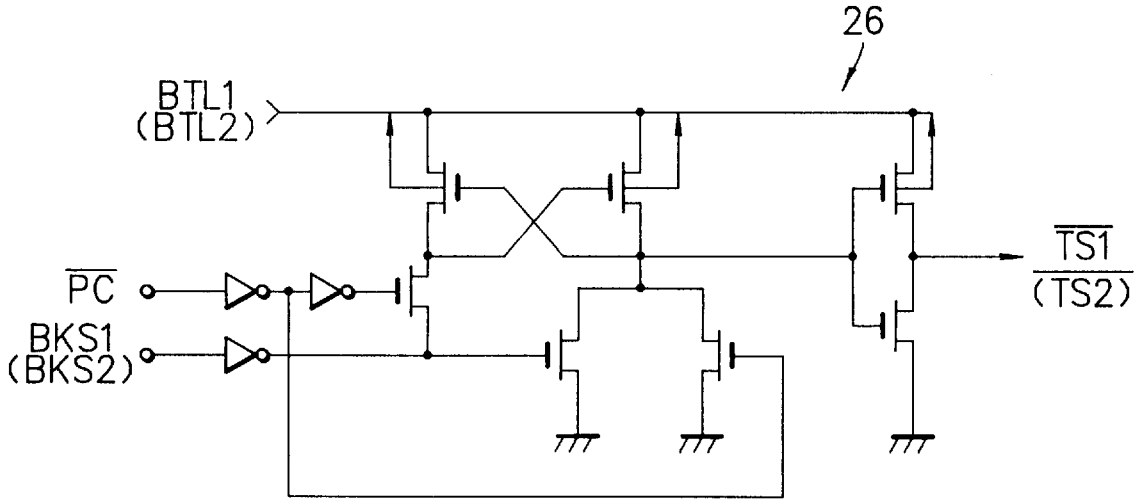
FIG. 10 is a circuit diagram of nand logic circuit of the voltage transferring device illustrated in FIG. 9.
Figure 12:
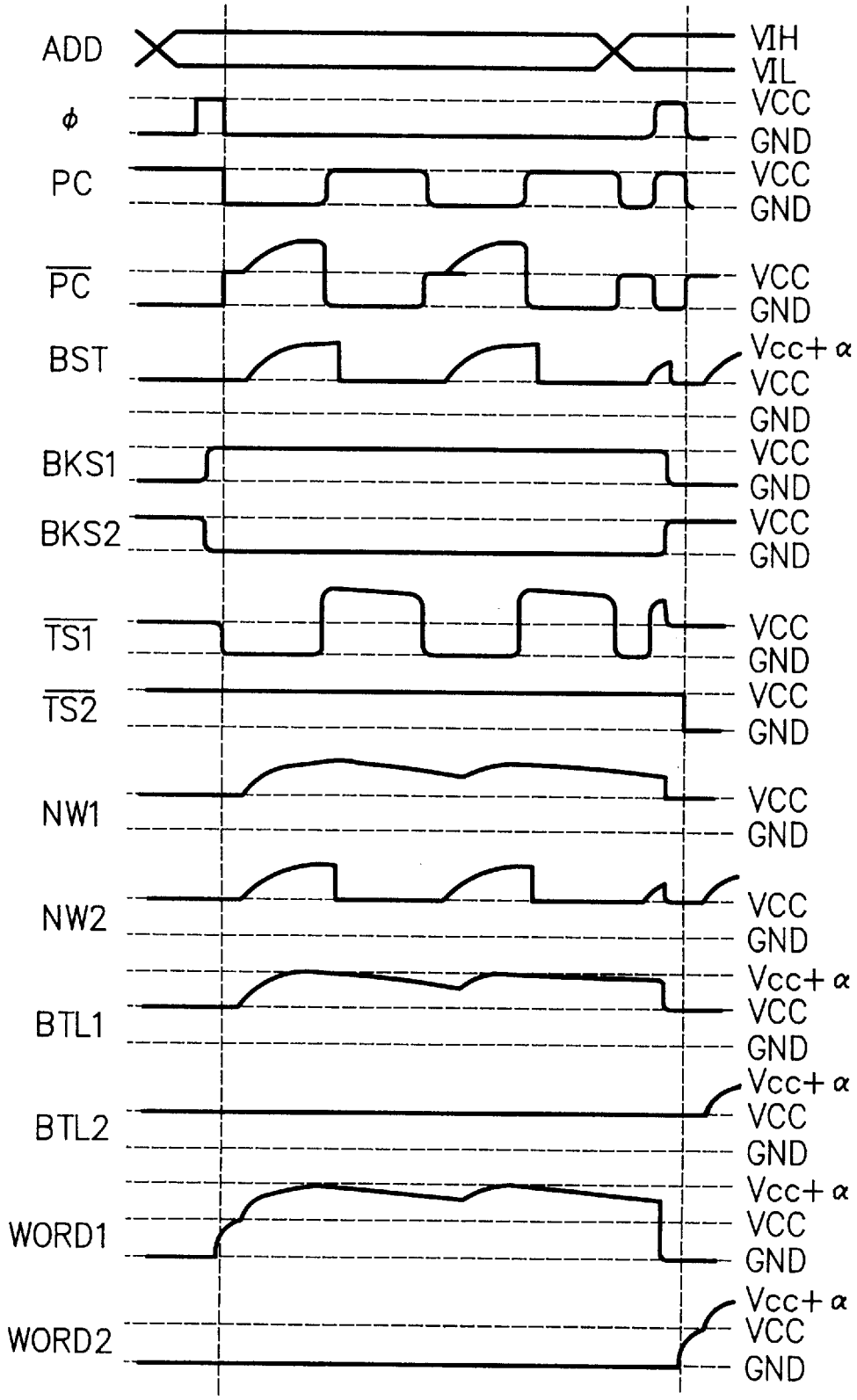
FIG. 12 is another view for use in describing operation of the voltage transferring device illustrated in FIG. 9.

Referring to FIGS. 11, and 12 together with FIGS. 9 and 10, the description will proceed to operation of the voltage transferring device 23.

When the control signal ϕ is set at the low level, the ring oscillating circuit 25 oscillates to supply the driving signal PC to the voltage boosting circuit 2 through gate circuits 41 and 42. The precharge operation and the boost operation are repeated every half-periods of pulses of the output of the ring oscillating circuit 25. Thereby, a voltage of a boost node BST, in the boost period, is boosted at Vcc. The voltage of the voltage transferring line BTL1, in about an address (ADD) period, is boosted at Vcc+α through the FET Q51. In this event, operations the FETs Q52, Q53, Q54, Q55, and Q56 are similar to the operations the FETs Q12, Q13, Q14, Q15, and Q16. Also, since the FET Q61 becomes on, the voltage of the voltage transferring line BTL2 is held at Vcc. Each of voltages of word lines WORD1 and WORD2 which are connected to the voltage receiving sections 3 and 4 are changed between the boost voltage Vcc+α and a reference voltage GND. In addition, voltages NW1 and NW2 of the FETs Q51 and Q52 are changed as shown in FIG. 12.

Figure 13:
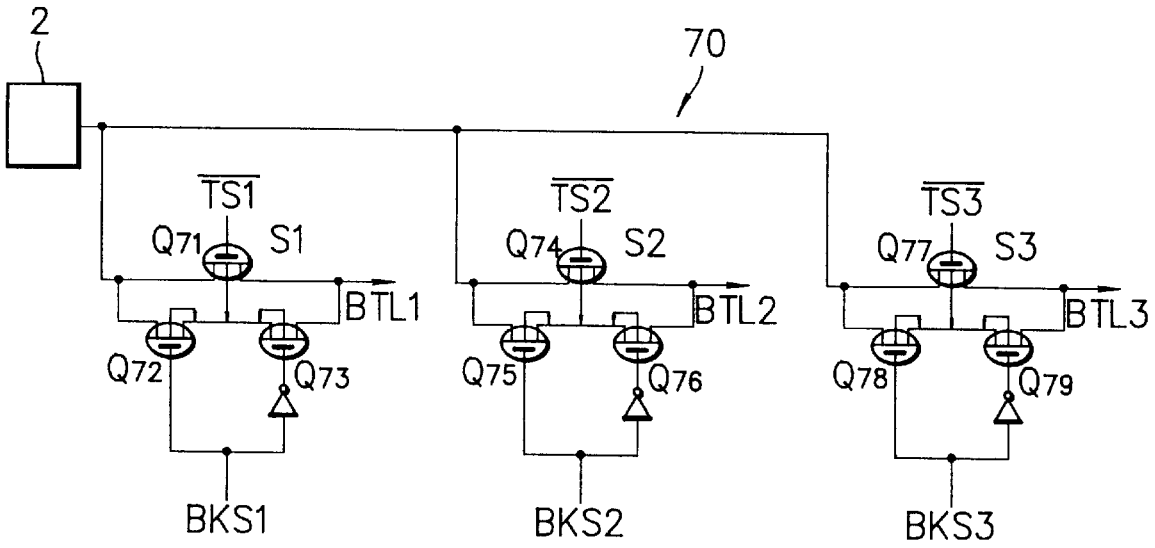
FIG. 13 is a circuit diagram of a voltage transferring device according to a third embodiment of this invention.
Figure 14:
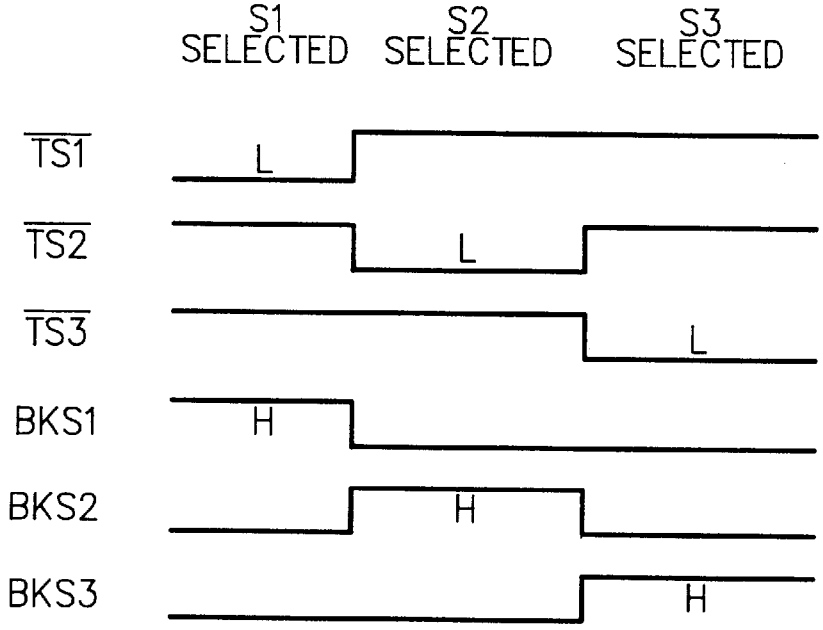
FIG. 14 is a view for use in describing operation of the voltage transferring device illustrated in FIG. 13.

Referring to FIGS. 13 and 14. the description will proceed to a voltage transferring device according to a third embodiment of this invention. Similar parts are designated by like reference numerals. In FIG. 13. the voltage transferring device 70 comprises the first voltage transferring circuit S1, the second voltage transferring circuit S2, and a third voltage transferring circuit S3.

The first voltage transferring circuit S1 comprises FETs Q71, Q72, and Q73 which are similar to the FETs Q11, Q13, and Q15. The second voltage transferring circuit S2 comprises FETs Q74, Q75, and Q76 which are similar to the FETs Q11, Q13, and Q15. The third voltage transferring circuit S3 comprises FETs Q77, Q78, and Q79 which are similar to the FETs Q11, Q13, and Q15.

As shown in FIG. 14, the first through third voltage transferring circuit S1 to S3 are selected by signals TS1, TS2, and TS3. When one of the signals TS1, TS2, and TS3 is set at the low level, a voltage of one of voltage transferring lines BSK1, BSK2, and BSK3 is boosted. Signals TS1, TS2, and TS3 are supplied to substrate electrodes of the FETs Q71, Q74, and Q77. The signals TS1, TS2, and TS3 are set at the high level in synchronizing with the signals TS1, TS2, and TS3. Thereby, it is prevented that electric charges flow form the voltage receiving sections to the voltage boosting circuit 2.

Thus, each of the voltage transferring devices 14, 23, and 70 of this invention comprises the only transferring FET which is serially connected between the voltage boosting circuit 2 and one of the voltage receiving sections. Therefore, each of the voltage transferring devices 14, 23, and 70 is capable of operating in a high speed because each of the voltage transferring devices 14, 23, and 70 is capable of decreasing a parastic resistance of a current passage. Thereby, it is assumed that each of the voltage transferring device 14, 23, and 70 is operated in the same apeed of the operation of the conventional voltage transferring device, each of the voltage transferring device 14, 23, and 70 may have about half of the mask area of the conventional voltage transferring device.

While this invention has thus far been described in conjunction with a few preferred embodiments thereof, it will readily be possible for those skilled in the art to put this invention into practice in various other manners. For example, the voltage transferring device may comprise the only first voltage transferring circuit S1. The controlling circuit 19 which controls the substrate electrodes of the transferring FETs may be implemented by switch elements except the FET. In addition, the voltage transferring device may comprise first through m-the voltage transferring circuits which are connected between the voltage boosting circuit 2 and first through m-the voltage receiving sections, respectively, where m represents an integer greater than four. In this event, since a parasitic capacitance of each of the voltage transferring circuits is decreased, charge in the voltage transferring period is quickly carried. Thereby, the voltage tansferring device is capable of operating in a high speed and by a small electric power.

What is claimed is:

1. A voltage transferring field effect transistor connected between a voltage supplying circuit at a first node and a voltage receiving circuit at a second node, said voltage supplying circuit supplying a first level to said first node during a first period and supplying a second level which is smaller than said first level to said first node during a second period, wherein said voltage transferring field effect transistor is conductive and a back bias voltage of said voltage transferring field effect transistor is set at a substrate electrode to a voltage of said first node during said first period, and said voltage transferring field effect transistor is non-conductive and said back bias voltage of said voltage transferring field effect transistor is set at said substrate electrode to a voltage of said second node during said second period.

2. A voltage transferring device connected between a voltage supplying section and a voltage receiving section, said voltage supplying section supplying, in a transferring period, a boost voltage having a boost level to said voltage receiving section, said boost voltage being greater than a supply voltage to said voltage supplying section, said voltage supplying section having, in a non-transferring period, a non-transferring voltage which has a non-transferring level smaller than said boost level, said voltage transferring device comprising:

a transferring field effect transistor having a source electrode connected to said voltage supplying section and a drain electrode connected to said voltage receiving section; and a controlling circuit connected to a substrate electrode of said transferring field effect transistor, said controlling circuit supplying, in said transferring period, a high voltage having said boost level to said substrate electrode, and said controlling circuit supplying, in said non-transferring period, a low voltage having said non-transferring level to said substrate electrode.

3. A voltage transferring device as claimed in claim 2, wherein said controlling circuit comprises:

a first field effect transistor having a drain electrode connected to said source electrode of said transferring field effect transistor and a source electrode connected to said substrate electrode of said transferring field effect transistor; and a second field effect transistor having a source electrode connected to said substrate electrode of said transferring field effect transistor and a drain electrode connected to said drain electrode of said transferring field effect transistor.

4. A voltage transferring device as claimed in claim 3, wherein said controlling circuit further comprises:

a gate voltage controlling circuit connected to gate electrodes of said first and second field effect transistors for: (i) supplying, in said transferring period, a first gate voltage to said gate electrode of said second field effect transistor so that said second field effect transistor turns on, (ii) supplying, in said transferring period, a second gate voltage to said gate electrode of said first field effect transistor so that said first field effect transistor turns off, (iii) supplying, in said non-transferring period, said first gate voltage to said gate electrode of said first field effect transistor so that said first field effect transistor turns on, and (iv) supplying, in said non-transferring period, said second gate voltage to said gate electrode of said second field effect transistor so that said second field effect transistor turns off.

5. A voltage transferring device as claimed in claim 3, wherein said controlling circuit further comprises:

a gate voltage controlling circuit connected to gate electrodes of said first and second field effect transistors for: (i) supplying, in said transferring period, a first gate voltage to said gate electrodes of said first and second field effect transistors so that said first and second field effect transistors turn on, (ii) supplying, in said non-transferring period, said first gate voltage to said gate electrode of said first field effect transistor so that said first field effect transistor turns on, and (iii) supplying, in said non-transferring period, a second gate voltage to said gate electrode of said second field effect transistor so that said second field effect transistor turns off.

6. A voltage transferring device connected between a voltage supplying section and first through n-th voltage receiving sections, where n represents an integer greater than two, said voltage supplying section supplying, in a transferring period, a boost voltage having a boost level to one of said first through n-th voltage receiving sections, said voltage supplying section having, said boost voltage being greater than a supply voltage to said voltage supplying section, in a non-transferring period, a non-transferring voltage which has a non-transferring level smaller than said boost level, said voltage transferring device comprising first through n-th voltage transferring circuits which are connected between said voltage supplying section and said first through n-th voltage receiving sections, respectively, one of said first through n-th voltage transferring circuits selectively transferring said boost voltage from said voltage supplying section to one of said first through n-th voltage receiving sections, each of said first through n-th voltage transferring circuits comprising:

a transferring field effect transistor having a source electrode connected to said voltage supplying section and a drain electrode connected to one of said first through n-th voltage receiving sections; and a controlling circuit connected to a substrate electrode of said transferring field effect transistor, said controlling circuit supplying, in said transferring period, a high voltage having said boost level to said substrate electrode of said transferring field effect transistor, and said controlling circuit supplying, in said non-transferring period, a low voltage having said non-transfer ring level to said substrate electrode of said transferring field effect transistor.

7. A voltage transferring device as claimed in claim 6, wherein said controlling circuit comprises:

a first field effect transistor having a drain electrode connected to said source electrode of said transferring field effect transistor and a source electrode connected to said substrate electrode of said transferring field effect transistor; and a second field effect transistor having a source electrode connected to said substrate electrode of said transferring field effect transistor and a drain electrode connected to said drain electrode of said transferring field effect transistor.

8. A voltage transferring device as claimed in claim 7, wherein said controlling circuit further comprises:

a gate voltage controlling circuit connected to gate electrodes of said first and second field effect transistors for supplying: (i) in said transferring period, a first gate voltage to said gate electrode of said second field effect transistor so that said second field effect transistor turns on, (ii) in said transferring period, a second gate voltage to said gate electrode of said first field effect transistor so that said first field effect transistor turns off, (iii) in said non-transferring period, said first gate voltage to said gate electrode of said first field effect transistor so that said first field effect transistor turns on, and, (iv) in said non-transferring period, said second gate voltage to said gate electrode of said second field effect transistor so that said second field effect transistor turns off.

9. A voltage transferring device as claimed in claim 7, wherein said controlling circuit further comprises:

a gate voltage controlling circuit connected to gate electrodes of said first and second field effect transistors for supplying: (i) in said transferring period, a first gate voltage to said gate electrodes of said first and second field effect transistors so that said first and second field effect transistors turn on, (ii) in said non-transferring period, said first gate voltage to said gate electrode of said first field effect transistor so that said first field effect transistor turns on, and (iii) in said non-transferring period, a second gate voltage to said gate electrode of said second field effect transistor so that said second field effect transistor turns off.

10. A voltage transferring device connected between a voltage supplying section and plural voltage receiving sections, said voltage supplying section supplying, in a transferring period, a boost voltage having a boost level to one of said plural voltage receiving sections, said voltage supplying section having, in a non-transferring period, a non-transferring voltage having a non-transferring level smaller than said boost level, said voltage transferring device comprising plural voltage transferring circuits connected between said voltage supplying section and said plural voltage receiving sections, respectively, one of said plural voltage transferring circuits selectively transferring said boost voltage from said voltage supplying section to one of said plural voltage receiving sections, each of said plural voltage transferring circuits comprising:

a transferring field effect transistor having a source electrode connected to said voltage supplying section and a drain electrode connected to one of said plural voltage receiving sections; and a controlling circuit connected to a substrate electrode of said transferring field effect transistor, said controlling circuit supplying, in said transferring period, a high voltage haaving said boost level to said substrate electrodes of said firstandsferring field effect transistor, said controlling circuit supplying, in said non-transferring period, a low voltage having said non-transferring level to said substrate electrode of said transferring field effect transistor, wherein said controlling circuit comprises:

a first field effect transistor having a drain electrode connected to said source electrode of said transfer ring field effect transistor and a source electrode connected to said substrate electrode of said transferring field effect transistor; and a second field effect transistor having a source electrode connected to said substrate electrode of said transferring field effect transistor and a drain electrode connected to said drain electrode of said transferring field effect transistor.

11. A voltage transferring device as claimed in claim 10, wherein said controlling circuit further comprises:

a gate voltage controlling circuit connected to gate electrodes of said first and second field effect transistors for supplying: (i) in said transferring period, a first gate voltage to said gate electrode of said second field effect transistor so that said second field effect transistor turns on, (ii) in said transferring period, a second gate voltage to said gate electrode of said first field effect transistor so that said first field effect transistor turns off, (iii) in said non-transferring period, said first gate voltage to said gate electrode of said first field effect transistor so that said first field effect transistor turns on, and (iv) in said non-transferring period, said second gate voltage to said gate electrode of said second field effect transistor so that said second field effect transistor turns off.

12. A voltage transferring device as claimed in claim 11, wherein said controlling circuit further comprises:

a gate voltage controlling circuit connected to gate electrodes of said first and second field effect transistors for supplying: (i) in said transferring period, a first gate voltage to said gate electrodes of said first and second field effect transistors so that said first and second field effect transistors turn on, (ii) in said non-transferring period, said first gate voltage to said gate electrode of said first field effect transistor so that said first field effect transistor turns on, and, (iii) in said non-transferring period, a second gate voltage to said gate electrode of said second field effect transistor so that said second field effect transistor turns off.

13. The device of claim 10, wherein said plural transferring sections comprise at least three sections.

14. The device of claim 11, wherein said plural transferring sections comprise at least three sections.

15. The device of claim 12, wherein said plural transferring sections comprise at least three sections.

* * * * *